United States Patent [19]

Crosio

[11] Patent Number: 4,553,868

[45] Date of Patent: Nov. 19, 1985

[54] DEVICE FOR MOUNTING A DAISYWHEEL ON A TYPEWRITER

[75] Inventor: Pasquale Crosio, Strambino, Italy

[73] Assignee: Ing. C. Olivetti & C., S.p.A., Turin, Italy

[21] Appl. No.: 588,724

[22] Filed: Mar. 12, 1984

[30] Foreign Application Priority Data

Mar. 10, 1983 [IT] Italy ..... 67270 A/83

[51] Int. Cl.[4] ..... B41J 11/22; B41J 1/22

[52] U.S. Cl. ..... 400/356; 400/144.2; 101/93.19

[58] Field of Search ..... 400/144.2, 175, 355, 400/356, 320, 174, 357; 101/93.18, 93.19, 93.20, 93.21

[56] References Cited

U.S. PATENT DOCUMENTS

| | | | |
|---|---|---|---|
| 4,036,348 | 7/1977 | Guerrini | 400/144.2 |
| 4,049,109 | 9/1977 | Plaza et al. | 400/144.2 X |
| 4,127,335 | 11/1978 | Bogert et al. | 400/144.2 |
| 4,161,373 | 7/1979 | Chvatlinsky | 400/144.2 X |
| 4,291,993 | 9/1981 | Gagnebin | 400/144.2 |
| 4,310,255 | 1/1982 | Asano et al. | 400/144.2 X |
| 4,324,496 | 4/1982 | Link | 400/144.2 |
| 4,386,864 | 6/1983 | Wang et al. | 400/144.2 X |
| 4,389,129 | 6/1983 | Sugiuro | 400/144.2 |
| 4,403,876 | 9/1983 | Vought | 400/144.2 |

FOREIGN PATENT DOCUMENTS

| | | | |
|---|---|---|---|
| 0029886 | 6/1981 | European Pat. Off. | 400/144.2 |
| 0038691 | 10/1981 | European Pat. Off. | 400/175 |
| 2806277 | 8/1979 | Fed. Rep. of Germany | 400/144.2 |
| 2924360 | 11/1980 | Fed. Rep. of Germany | 400/144.2 |
| 0086760 | 7/1981 | Japan | 400/175 |
| 0144969 | 11/1981 | Japan | 400/144.2 |

OTHER PUBLICATIONS

IBM Tech. Disc. Bulletin, "Impart Printer with Cassette Daisywheel Type Font", Roberti et al., vol. 22, No. 1, Jun. 1979, pp. 1–3.

IBM Tech. Disc. Bulletin, "Automated Printwheel Removal Mechanism", Okcuoglu et al., vol. 22, No. 4, Sep. 1979, pp. 1538–1539.

*Primary Examiner*—Edgar S. Burr

*Assistant Examiner*—James R. McDaniel

*Attorney, Agent, or Firm*—Banner, Birch, McKie & Beckett

[57] ABSTRACT

The device for mounting a daisy-wheel character carrying disc (70) in a printing machine comprises a frame (22) which is pivoted on a guide (13) of the carriage (12) that is parallel to the platen roller (11) and on which are mounted a selector motor (15) with which the character carrying disc is to be coupled, a striker hammer (16) and a pocket (60) into which the character carrying disc is inserted. A manually actuable mechanism (40) causes the frame (22), striker hammer (16) and the selector motor (15) to swing away from the platen roller (11) and at the same time causes the pocket (60) to be lifted, thus permitting the character carrying disc (70) to be removed and/or inserted from above. Coaxial coupling between the motor shaft (76) and the disc (70) and positioning of the disc between the platen roller and the striker hammer are effected automatically by manually actuating the mechanism (40) connected to the frame (22) to swing the frame back again towards the platen.

6 Claims, 6 Drawing Figures

DEVICE FOR MOUNTING A DAISYWHEEL ON A TYPEWRITER

BACKGROUND OF THE INVENTION

The present invention relates to a device for mounting a character carrying disc (commonly called a daisywheel) in a typewriter or other printing machine having a platen roller, a carriage slidable on a guide parallel to the platen roller, a selector motor and a striker hammer. The device comprises a frame which is pivoted relative to the carriage, e.g. on the guide that is parallel to the roller, and is movable together with the carriage and on which are mounted the selector motor and the striker hammer, and a mechanism connected to the carriage and to the frame to swing the frame with respect to the carriage and to move the selector motor and the striker away from the platen roller.

A device is known in which, in order to mount a character carrying disc, the frame is swung by about 60° in order to move the motor and the hammer far away from the roller and thus permit the operator to remove any character carrying disc which is already fitted into the machine and to fit another thereof, the character carrying disc being directly and manually coupled to the shaft of the selector motor. In order to move the frame into the highly inclined position referred to above it is therefore necessary first to remove the cartridge containing the inked ribbon and which is carried on the carriage above the frame itself. It will be appreciated that all that requires laborious and rather long operations which mean that that apparatus is not really a practical proposition.

In addition, with that device, it is the operator who, besides the actual operations of removing and exchanging the character carrying disc, must also attend to coaxial coupling between the disc and the shaft of the selector motor.

Also known is a device in which the selector motor and the print hammer remain fixed in their operating positions during the operation of fitting the character carrying disc. Mounted on the carriage, between the motor and the roller, are two substantially vertical guides which are capable of guiding the character carrying disc downwardly to position it in association with the shaft of the selector motor.

A manually actuable mechanism is arranged to incline the character carrying disc for coupling it to the motor shaft. In that device therefore, each character carrying disc must be provided with lateral posts or lugs which are co-operable both with the vertical guides and with the manual mechanism which causes the disc to take up an inclined position for coupling it to the motor, so that the system, taken overall, is very expensive.

SUMMARY OF THE INVENTION

The object of the present invention is to provide an device which, besides being simple and economical, permits a character carrying disc to be fitted in a printing machine without any necessity to remove a ribbon cartridge beforehand and without the operator being required himself to carry out the step of coupling the disc to the motor.

The device according to the invention is defined in claims below.

These and other features of the invention will be clearly apparent from the following description of a preferred embodiment which is given by way of non-limiting example, with reference to the accompanying drawings.

DETAILED DESCRIPTION OF A PREFERRED EMBODIMENT

Figure 1:
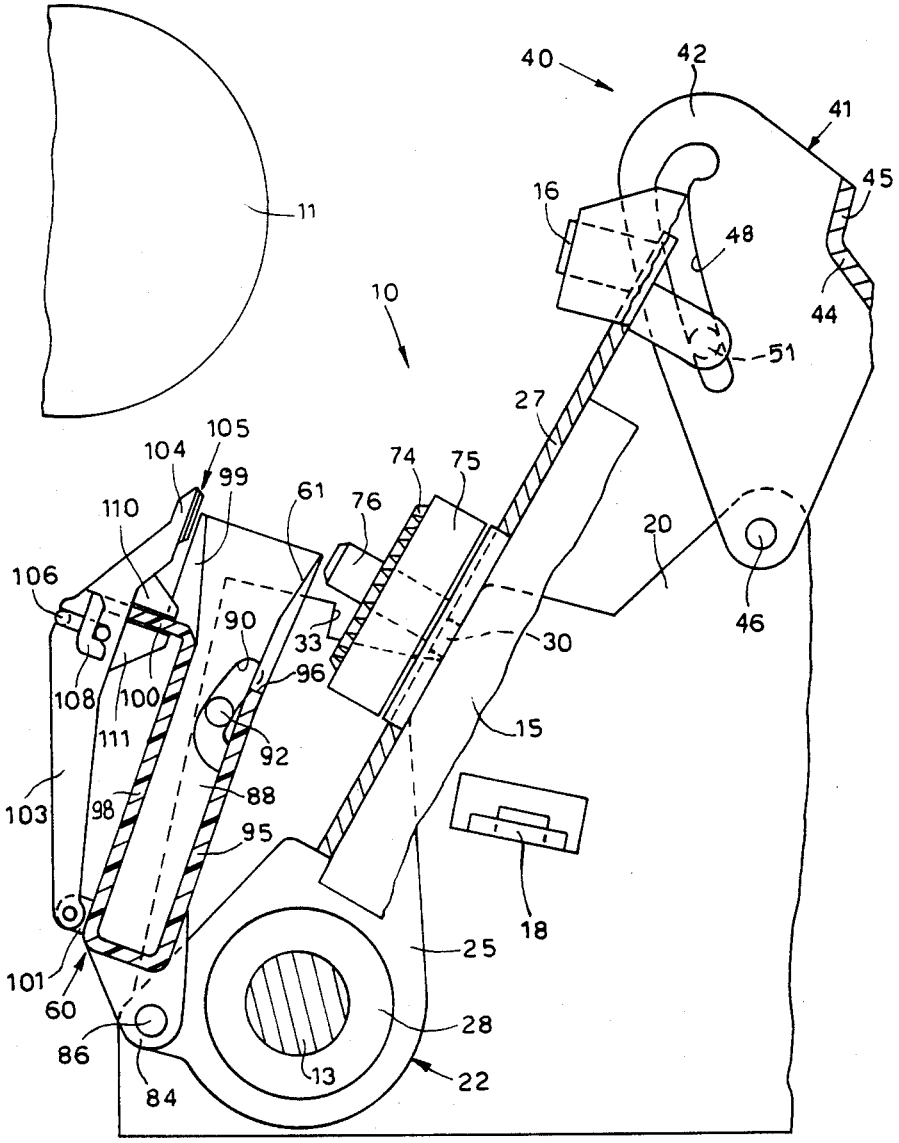
FIG. 1 is a partly sectional side view from the left of an apparatus according to the invention in a loading position.

Referring to FIG. 1, a device 10 according to the invention is shown applied to a printing machine which comprises a platen roller 11, a carriage 12 which is slidable on a cylindrical guide 13 parallel to the roller 11, a selector motor 15, for example of stepping type, and a striker hammer 16. The carriage 12 in particular comprises two side members 20 and 21 (see FIGS. 4 and 5) which are parallel to each other and orthogonal to the axis of the guide 13.

Figure 4:
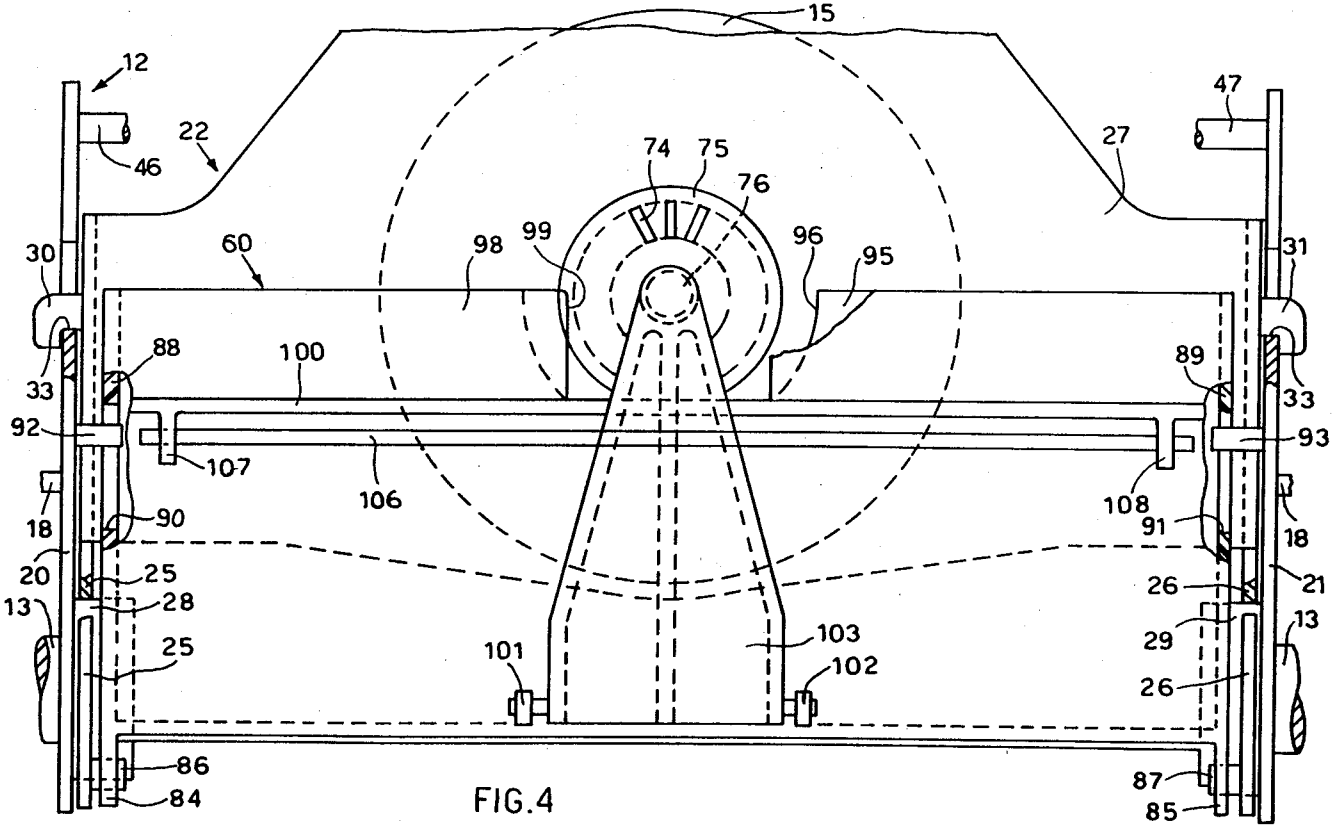
FIG. 4 is a first partly sectional rear view of the apparatus shown in FIG. 1.
Figure 5:
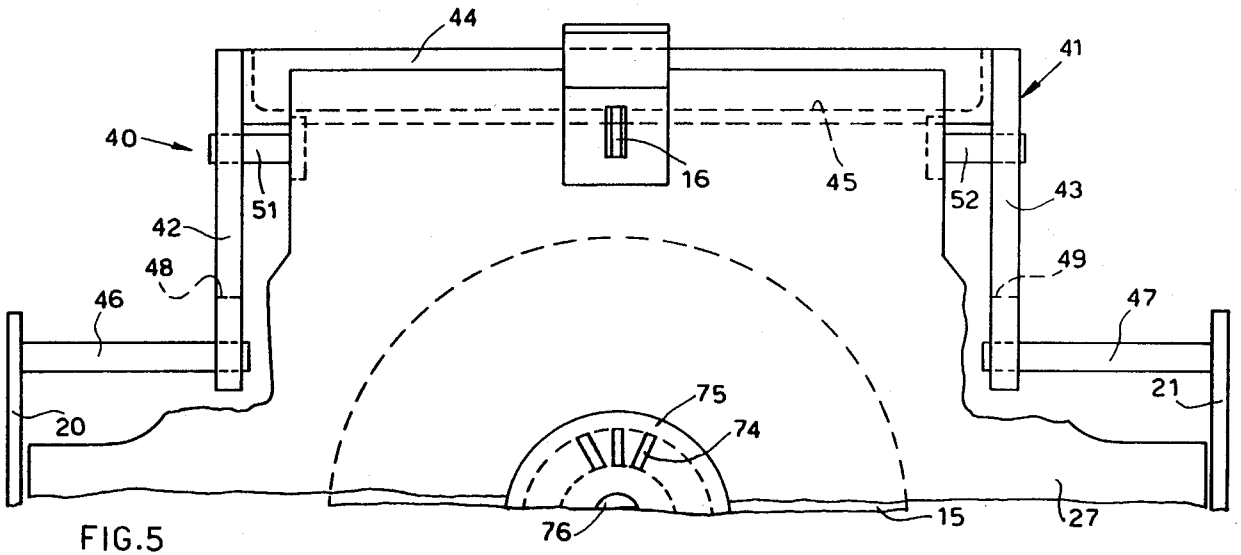
FIG. 5 is a second partly sectional rear view of the apparatus shown in FIG. 1.

The translatory movement of the carriage 12 in front of the roller 11 is controlled by a motor (not shown), by means of a belt 18 connected to the side members 20 and 21 of the carriage 12 (see FIGS. 1 and 4).

The device 10 in turn comprises a frame 22 which is disposed between the side members 20 and 21 of the carriage 12 and which is shaped in such a way as to have two side members 25 and 26 and a plate member 27 which is parallel to the platen roller 11 and on which the motor 15 and the hammer 16 are mounted.

The side members 25 and 26 of the frame 22 are fixed to two bushes 28 and 29 which are mounted, coaxially with the guide 13, within the side members 20 and 21 of the carriage 12. In that way, the frame 22 is pivoted with respect to the guide 13 and follows the movements of the carriage 12 in front of the platen roller 11.

The plate member 27 of the frame 22 is provided with two side lug portions 30 and 31 which each co-operate with an opening 33 provided in each side member 20 and 21 of the carriage 12. The openings 33 which co-operate with the lug portions 30 and 31 limit to 16° the turning movement that the frame 22 can perform with respect to the guide 13.

A mechanism 40 (see FIGS. 1 and 5) comprising a bridge lever 41, which can be actuated manually, is arranged to control the inclined positioning of the frame 22.

In particular, the lever 41 comprises two side arm portions 42 and 43 which are parallel to the side members 20 and 21 of the carriage 12, and a transverse portion 44 which is so shaped as to define a cavity 45 in which the operator can rest the fingers of a hand to move the lever 41 towards the roller 11 or move it away therefrom, as described hereinafter.

The arm portions 42 and 43 of the lever 41 are pivoted on two pins 46 and 47 which are fixed to the side members 20 and 21 of the carriage 12 and are provided with slots 48 and 49 respectively with which pegs 51 and 52 on the frame 22 co-operate.

Figure 2:
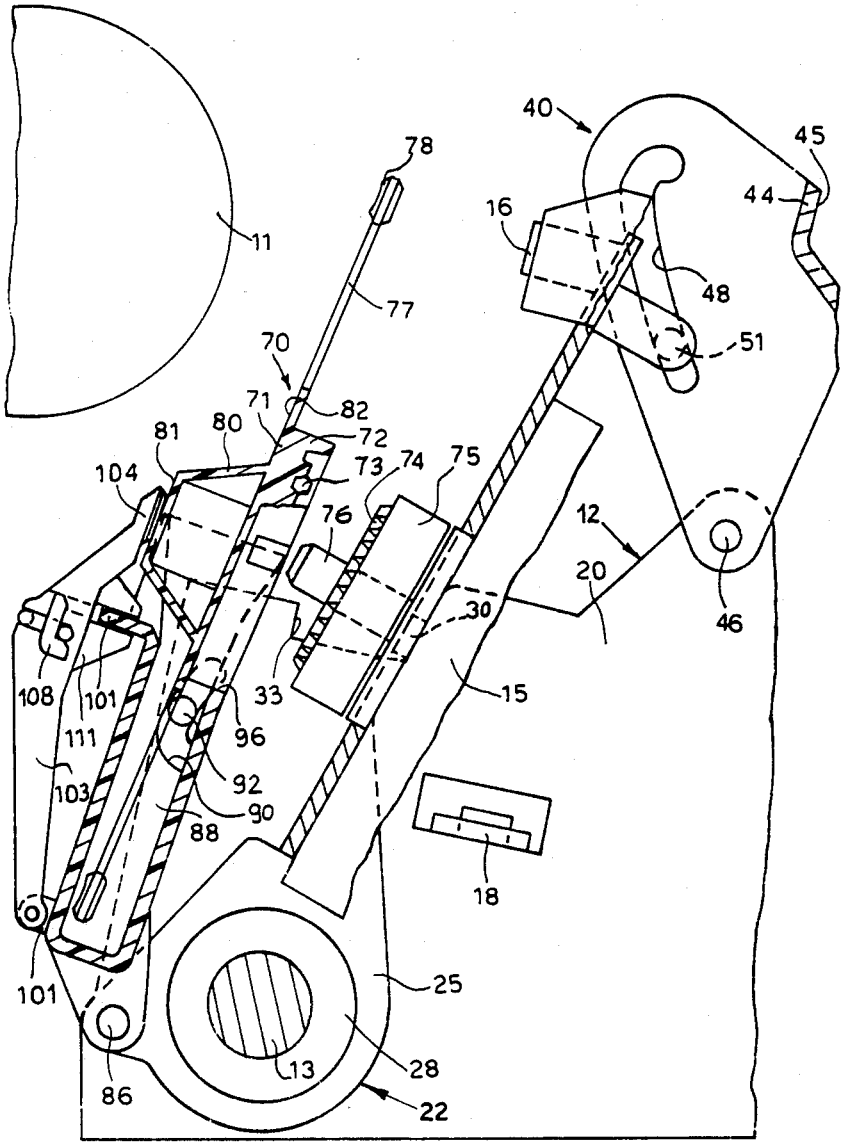
FIG. 2 is a partly sectional side view from the left of an apparatus according to the invention in the loading position, with a character carrying disc fitted therein.
Figure 3:
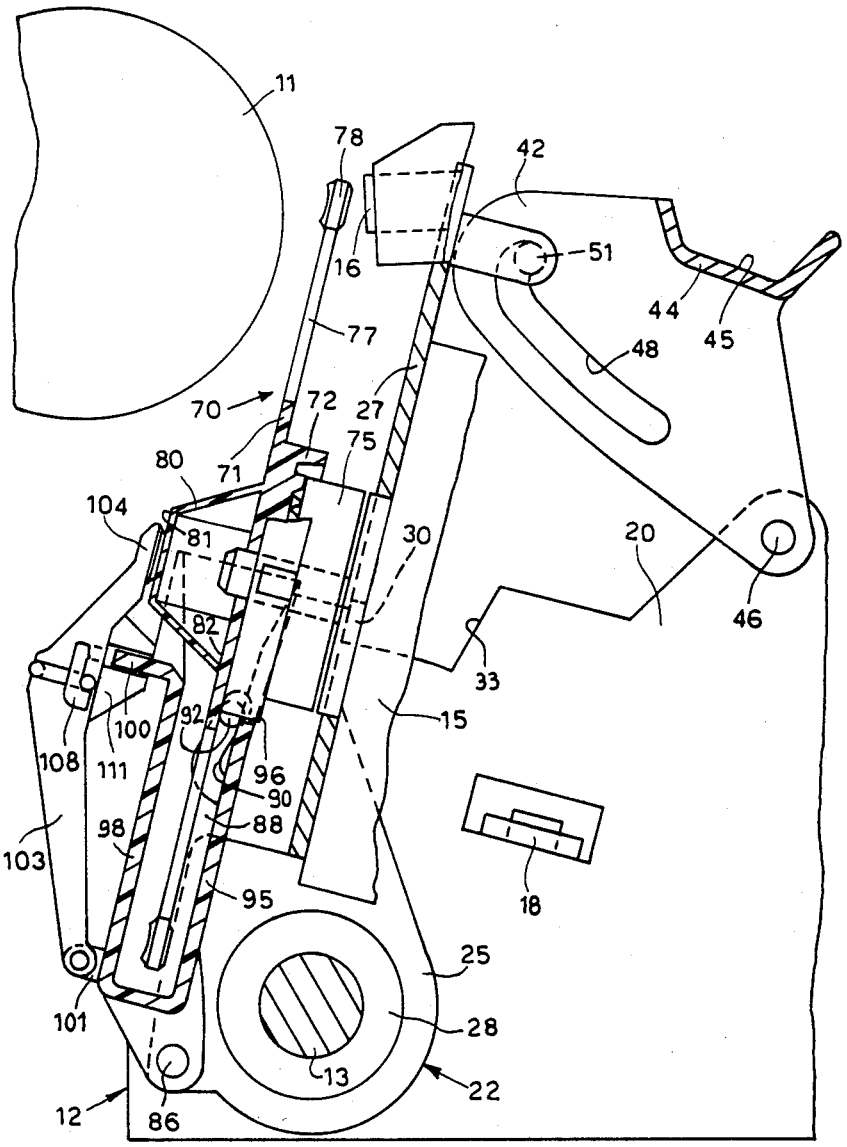
FIG. 3 is a partly sectional side view from the left of the apparatus according to the invention in an operating position.

The slots 48 and 49 are of such a shape that a rotary movement of the frame 22 in the anticlockwise direction corresponds to a similar rotary movement in an anticlockwise direction of the lever 41 (see FIGS. 1 to 3).

In accordance with a feature of the invention, a box-like container or pocket 60 of plastics material is disposed in a substantially vertical position between the frame 22 and the platen roller 11. The pocket 60 is of substantially parallelepipedic shape and has an upper opening 61 into which can be dropped a character carrying disc 70 of known type, for example of the type described in the U.S. patent application Ser. No. 582,777, filed on Feb. 23, 1984, and assigned to the same assignee of the present invention.

In particular, the disc 70 (see FIGS. 2 and 3) comprises a central hub portion 71 and a plurality of radial, flexible blade portions 77, at the end of each of which is a raised print character 78. Provided on a cylindrical part 72 of the hub portion 71 are coupling means 73 which are capable of coupling to corresponding coupling means 74 provided on the front surface of a flange 75 which is fixed on a shaft 76 of the motor 15. A handle 80 having a front wall portion 81 is fixed on a front surface 82 of the central hub portion 71.

At its sides and at the bottom, the pocket 60 is provided with two projections 84 and 85 which are pivotally mounted on pins 86 and 87 of the frame 22 (see FIGS. 1 and 4). Also provided in the two side members 88 and 89 of the pocket 60 are two slots 90 and 91 respectively, with which pegs 92 and 93 of the carriage 12 cooperate. The slots 90 and 91 are so shaped that a rotary movement in the clockwise direction of the frame 22 (see FIGS. 1 to 3) corresponds to a substantially vertical lifting movement of the pocket 60 combined with a slight turning movement in the clockwise direction of the pocket 60. The lifting arises because the pivot pins 85 and 86 rise when the frame is swung clockwise. The turning of the pocket 60 is much less than the turning of the frame 22 whereby the motor shaft 76 withdraws from the disc 70 to allow the old disc to be lifted out and a new disc dropped in.

On a rear wall portion 95 (see FIG. 4), the pocket 60 is also provided with semicylindrical recess 96 against which the character carrying disc 70 can bear by means of its cylindrical portion 72 during the phase of inserting the disc 70 (see FIG. 2).

Figure 6:
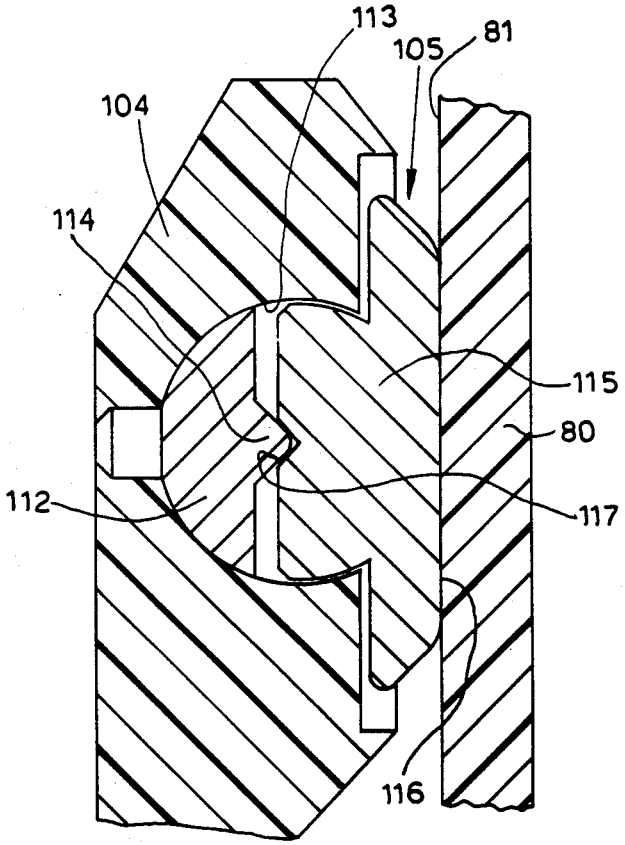
FIG. 6 is a sectional view on an enlarged scale of a detail of the apparatus shown in FIG. 1.

Provided on a front wall portion 98 (see FIG. 4) of the pocket 60 is a central, substantially rectangular recess 99 and an outside, horizontal rib 100. A lever 103 is pivotally mounted on two lower lug portions 101 and 102 of the pocket 60 and at its upper end 104 carries an element 105 (see FIGS. 1 and 6) which is capable of co-operating with the wall portion 81 of the handle 80 of the character carrying disc 70.

The lever 103 is constantly biased towards the wall portion 98 of the pocket 60 by a spring 106 (see FIG. 4) comprising a steel wire or rod whose ends are engaged with two vertical lug portions 107 and 108 disposed at the ends of the horizontal rib 100. The lever 103 is provided with two guide lug portions 110 and 111 (see FIG. 1) which co-operate with the rib 100.

The element 105 (see FIG. 6) in turn comprises a metal disc 112 which is trapped in a spherical seat 113 provided on the end 104 of the lever 103, and is provided with a pointed pivot pip 114. Another metal disc 115 has an internal part which is housed with clearance in the seat 113, and an external part having a flat front surface 116 arranged to bear against the wall portion 81 of the character carrying disc 70. The internal part of the disc 115 is provided with a flared or V-shaped recess 117 in which the pivot pip 114 of the fixed disc 112 engages.

The mode of operation of the above-described apparatus is as follows:

It will be assumed that a character carrying disc 70 is to be fitted into the printing machine.

First of all, the frame 22 (see FIG. 1) is swung forward on the guide 13, with the lever 41 rotating in a clockwise direction in FIG. 1. To do this, the operator pulls the lever 41 towards him (towards the right in FIG. 1), by operating on the transverse portion 44. When that is done, the frame 22 and the pocket 60 connected thereto are in the position shown in FIG. 1, with the motor 15 and the hammer 16 sufficiently spaced from the platen roller 11 to permit a character carrying disc 70 to be easily inserted from above. That operation can be performed without removing the cartridge carrying the inked ribbon (not shown in the drawings). A disc 70 is put into the pocket 60, care simply being taken to dispose the characters 78 towards the platen roller 11 but without positioning the disc 70 angularly with respect to the shaft 76 of the motor 15.

Once the disc 70 has been fitted into the pocket 60, the disc 70 (see FIG. 2) rests with its cylindrical part 72 against the semicylindrical recess 96 and with the wall portion 81 of its handle 80 against the disc 115 of the backing element 105. In order to move the motor 15 and the hammer 16 back into the operating position, as shown in FIG. 3, and to provide for automatic coupling as between the flange 75 on the motor shaft 76 and the character carrying disc 70, the lever 41 is rotated in the anticlockwise direction with respect to the carriage 12. To do this, the operator pushes the lever 41 towards the roller 11 (towards the left in FIG. 3).

In particular, the anticlockwise turning movement of the lever 41 causes corresponding anticlockwise turning movement of the frame 22 with respect to the guide 13. In turn, by virtue of the connection between the pins 86 and 87 (see FIG. 4) and the projections 84 and 85 of the pocket 60, the last-mentioned turning movement causes a substantial downward motion of the pocket 60 which also performs a slight turning motion in an anticlockwise direction (see FIGS. 1 to 3) due to the co-operation of the slots 90 and 91 (see FIG. 4) with the pegs 92 and 93 of the carriage 12. This particular movement of the pocket 60 and the frame 22 provides for automatic and immediate coupling of the character carrying disc 70 to the shaft 76 and the flange 75 (see FIG. 3) and in particular the coupling means 73 of the disc 70 to the corresponding coupling means 74 of the flange 75. The lever 103, by virtue of the thrust force applied thereto by the spring 106, promotes the interconnection of the disc 70 and the flange 75, while slightly resisting the turning movement of the frame 22. The force of the spring 106 however is not such as to prevent the turning movement being completed.

Once the disc 70 has been coupled to the shaft 76, the disc 70 is disposed substantially parallel to the wall portions 95 and 98 of the pocket 60, with its cylindrical portion 72 slightly raised with respect to the recess 96, whereby it can rotate freely within the pocket 60.

The spring 106 holds the disc 70 coupled to the shaft 76 of the motor 15.

The element 105 (see FIG. 6) also provides that the rotary movement of the disc 70, for selecting the character to be printed, takes place without excessive friction. In fact, the external disc 115 rotates freely, together with the disc 70, with respect to the internal portion 112 which remains fixed, and the particular connection between the pointed portion 114 and the recess 117 minimises the resistance to such reciprocal rotary movement.

Angular positioning of the character carrying disc 70 and the motor shaft 76 connected thereto is effected in known manner, for example as described in the U.S. patent application Ser. No. 582,611, filed on Feb. 22, 1984, and assigned to the same assignee of the present invention.

What I claim is:

1. A device for mounting a character carrying disc provided with a cylindrical hub portion in a printing machine having a platen, a fixed guide parallel to said platen, a carriage slidable on said guide, a frame pivotally mounted on said carriage, a selecting motor mounted on said frame and having a motor shaft for engaging said disc, a striker hammer mounted on said frame, and a mechanism connected to said carriage and to said frame for swinging said frame with respect to said carriage to move said selecting motor and said striker hammer away from said platen, said device comprising a substantially vertical pocket having two lateral sides perpendicular to said fixed guide and a wall parallel to said fixed guide, said pocket being disposed between said platen and said frame for lodging said character carrying disc, and means for allowing easy insertion of said character carrying disc in said pocket and a simultaneous coaxial coupling of said motor shaft with the introduced character carrying disc, said allowing means comprising a lower portion of said pocket which is pivotally connected to said frame near said fixed guide, a pin and slot coupling between said carriage and at least one of said lateral sides of said pocket so that the swinging of said frame with respect to said carriage causes a corresponding vertical movement of said pocket with respect to said fixed guide, and a semicylindrical recess on said wall of said pocket for carrying said cylindrical hub portion of said disc during the insertion thereof, said semicylindrical recess being substantially coaxial to said motor shaft.

2. A device according to claim 1, wherein said motor shaft comprises first coupling means, and wherein said character carrying disc is provided on said cylindrical hub portion with second coupling means adapted to mate with said first coupling means of said motor shaft.

3. A device according to claim 2, wherein the swinging of said frame towards said platen causes the coupling of said second coupling means of said disc to said first coupling means of said motor shaft.

4. A device according to claim 3, wherein a backing element is mounted on said pocket in front of said wall for co-operating with said character carrying disc to hold said first and second coupling means mated therebetween.

5. A device according to claim 1, wherein said mechanism comprises a lever pivoted on said carriage and coupled to said frame by a pin and slot coupling such that the turning movement of said lever on said carriage causes a like turning movement of said frame on said carriage.

6. A device according to claim 4, wherein said backing element comprises a lever pivoted on said pocket and having at one end a recess within which metal pivot pin is fixed and a metal disc is arranged to rotate freely, said metal disc having an internal surface provided with a flared recess cooperating with said pivot pin and an external front surface which bears against said character carrying disc.

* * * * *